US011542943B2

(12) United States Patent
De Bock et al.

(10) Patent No.: US 11,542,943 B2
(45) **Date of Patent: *Jan. 3, 2023**

(54) LIQUID RING PUMP MANIFOLD

(71) Applicant: Edwards Technologies Vacuum Engineering (Qingdao), Co. Ltd., Qingdao (CN)

(72) Inventors: Andries Daniel Jozef De Bock, Qingdao (CN); Mark Gordon Glaister, Bolton (GB)

(73) Assignee: Edwards Technologies Vacuum Engineering (Qingdao) Company Limited, Qingdao (CN)

( * ) Notice: Subject to any disclaimer, the term of this patent is extended or adjusted under 35 U.S.C. 154(b) by 116 days.

This patent is subject to a terminal disclaimer.

(21) Appl. No.: 16/979,850

(22) PCT Filed: Mar. 14, 2019

(86) PCT No.: PCT/IB2019/052070

§ 371 (c)(1),
(2) Date: Sep. 10, 2020

(87) PCT Pub. No.: WO2019/175821

PCT Pub. Date: Sep. 19, 2019

(65) Prior Publication Data

US 2021/0048027 A1 Feb. 18, 2021

(30) Foreign Application Priority Data

Mar. 14, 2018 (GB) ..... 1804106

(51) Int. Cl.

| | |
|---|---|
| ***F04C 19/00*** | (2006.01) |
| ***F04C 29/04*** | (2006.01) |
| ***F04C 25/02*** | (2006.01) |

(52) U.S. Cl.
CPC ..... *F04C 19/005* (2013.01); *F04C 19/00* (2013.01); *F04C 19/004* (2013.01);
(Continued)

(58) Field of Classification Search
CPC .... F04C 19/004; F04C 19/008; F04C 29/042; F04C 19/00; F04C 19/007; F04C 25/02; F04C 19/005
See application file for complete search history.

(56) References Cited

U.S. PATENT DOCUMENTS 3,642,384 A * 2/1972 Huse ..... F04C 19/00 417/69
4,498,844 A * 2/1985 Bissell ..... F04C 19/008 417/68

(Continued)

FOREIGN PATENT DOCUMENTS

CA 2524413 A1 4/2006
CN 101201051 A 6/2008

(Continued)

OTHER PUBLICATIONS

Extended Search Report from counterpart European Application No. 19766796.7 dated Oct. 28, 2021, 7 pp.

(Continued)

*Primary Examiner* — Peter J Bertheaud
(74) *Attorney, Agent, or Firm* — Shumaker & Sieffert, P.A.

(57) ABSTRACT

A liquid ring pump manifold comprising at least one integrated spray nozzle, the at least one integrated spray nozzle being configured to spray a liquid into the liquid ring pump manifold. The liquid ring pump manifold may comprise at least one socket in which the at least one integrated spray nozzle is accommodated. The at least one socket may be integrally formed with the liquid ring pump manifold.

16 Claims, 7 Drawing Sheets

(52) U.S. Cl.
CPC ..... *F04C 19/007* (2013.01); *F04C 19/008* (2013.01); *F04C 25/02* (2013.01); *F04C 29/042* (2013.01)

(56) References Cited

U.S. PATENT DOCUMENTS

| | | | | |
|---|---|---|---|---|
| 4,565,498 | A | 1/1986 | Schmid et al. | |
| 4,756,672 | A * | 7/1988 | Trimborn | F04C 19/004 417/68 |
| 5,588,806 | A | 12/1996 | Trimbom et al. | |
| 9,541,086 | B2 | 1/2017 | Beers et al. | |
| 2015/0361979 | A1 | 12/2015 | Kosters et al. | |
| 2017/0130718 | A1 | 5/2017 | Kosters et al. | |

FOREIGN PATENT DOCUMENTS

| | | | |
|---|---|---|---|
| CN | 201180663 | Y | 1/2009 |
| CN | 105026758 | A | 11/2015 |
| CN | 105793571 | A | 7/2016 |
| CN | 106536936 | A | 3/2017 |
| CN | 205991014 | U | 3/2017 |
| CN | 206159016 | U | 5/2017 |
| DE | 944393 | C | 6/1956 |
| DE | 1111335 | B | 7/1961 |
| EP | 0138182 | A2 | 4/1985 |
| GB | 376690 | A | 7/1932 |
| GB | 405542 | A | 2/1934 |
| GB | 985951 | A | 3/1965 |
| GB | 2571969 | A | 9/2019 |
| JP | 2000199490 | A | 7/2000 |
| WO | 199419610 | A1 | 9/1994 |
| WO | 199846885 | A1 | 10/1998 |
| WO | 2003083307 | A1 | 10/2003 |

OTHER PUBLICATIONS

Translation of the First Office Action from counterpart Chinese Application No. 201980019197.4 dated Nov. 18, 2021, 10 pp.

Written Opinion and International Search Report dated Jul. 19, 2019 in counterpart International Application No. PCT/IB2019/052070, 11 pp.

* cited by examiner

LIQUID RING PUMP MANIFOLD

This application is a national stage entry under 35 U.S.C. § 371 of International Application No. PCT/IB2019/052070, filed Mar. 14, 2019, which claims the benefit of GB Application 1804106.1, filed Mar. 14, 2018. The entire contents of International Application No. PCT/IB2019/052070 and GB Application 1804106.1 are incorporated herein by reference.

TECHNICAL FIELD

The present disclosure relates to liquid ring pump manifolds such as liquid ring pump inlet manifolds and liquid ring pump outlet manifolds.

BACKGROUND

Liquid ring pumps are a known type of pump which are typically commercially used as vacuum pumps and as gas compressors. Liquid ring pumps typically include a housing with a chamber therein, a shaft extending into the chamber, an impeller mounted to the shaft, and a drive system such as a motor operably connected to the shaft to drive the shaft. The impeller and shaft are positioned eccentrically within the chamber of the liquid ring pump.

In operation, the chamber is partially filled with an operating liquid (also known as service liquid). When the drive system drives the shaft and the impeller, a liquid ring is formed on the inner wall of the chamber, thereby providing a seal that isolates individual volumes between adjacent impeller vanes. The impeller and shaft are positioned eccentrically to the liquid ring, which results in a cyclic variation of the volumes enclosed between adjacent vanes of the impeller and the liquid ring.

In a portion of the chamber where the liquid ring is further away from the shaft, there is a larger volume between adjacent impeller vanes which results in a smaller pressure therein. This allows the portion where the liquid ring is further away from the shaft to act as a gas intake zone. In a portion of the chamber where the liquid ring is closer to the shaft, there is a smaller volume between adjacent impeller vanes which results in a larger pressure therein. This allows the portion where the liquid ring is closer to the shaft to act as a gas discharge zone.

Examples of liquid ring pumps include single-stage liquid ring pumps and multi-stage liquid ring pumps. Single-stage liquid ring pumps involve the use of only a single chamber and impeller. Multi-stage liquid ring pumps (e.g. two-stage) involve the use of multiple chambers and impellers connected in series.

SUMMARY

In a first aspect, the present disclosure provides a liquid ring pump manifold comprising at least one integrated spray nozzle, the at least one integrated spray nozzle being configured to spray a liquid into the liquid ring pump manifold.

The liquid ring pump manifold may comprise a first branch through which fluid can flow. The first branch may split into multiple branches through which fluid can flow. The multiple branches may include at least a second branch and a third branch. The first branch may bifurcate into the second branch and the third branch. The liquid ring pump manifold may comprise a first integrated spray nozzle positioned so as to spray liquid into the second branch and a second integrated spray nozzle positioned so as to spray liquid into the third branch.

The liquid ring pump manifold may comprise at least one socket in which the at least one integrated spray nozzle is accommodated. The at least one socket may be integrally formed with the liquid ring pump manifold (e.g. integrally formed with a wall of the liquid ring pump manifold).

The liquid ring pump manifold may comprise an integrated non-return valve, the integrated non-return valve being configured to permit flow of fluid through the liquid ring pump manifold in a first direction and to prevent or oppose flow of fluid through the liquid ring pump manifold in a second direction, the second direction being opposite to the first direction. The integrated non-return valve may comprise an annular flange defining an opening. The integrated non-return valve may comprise an object movable between a first position and a second position. In the first position the object may be located away from the opening so as to not block the opening. In the second position the object may abut the annular flange so as to block the opening. The annular flange may be integrally formed with a wall of the liquid ring pump manifold. The annular flange may comprise a chamfered rim circumscribing the opening. The integrated non-return valve may comprise a holder configured to hold the object when the object is in the first position. The holder may comprise at least one protrusion extending from an inner surface of the liquid ring pump manifold. The object may be substantially spherical. The opening may be substantially circular. The object may be made of an elastomeric material.

The liquid ring pump manifold may comprise an access port for providing access to an interior of the liquid ring pump manifold from outside of the liquid ring pump manifold. The liquid ring pump manifold may comprise a removable cover configured to seal the access port so as to prevent fluid flowing from the interior of the liquid ring pump manifold out of liquid ring pump manifold through the access port. The removable cover may partially define an inner surface of the liquid ring pump manifold when sealing the access port.

The integrated non-return valve may comprise a holder configured to hold the object when the object is in the first position. The holder may be attached to the removable cover.

The integrated non-return valve may be disposed at least partially within the first branch. The integrated non-return valve may be fully disposed within the first branch.

The at least one socket may be formed in the removable cover. The at least one integrated spray nozzle may form at least part of the holder. The at least one socket may form at least part of the holder.

The liquid ring pump manifold may be selected from the group of manifolds consisting of: a liquid ring pump inlet manifold, and a liquid ring pump outlet manifold.

In a further aspect, the present disclosure provides a liquid ring pump comprising a housing defining a chamber therein, a shaft extending into the chamber, an impeller fixedly mounted to the shaft, and the liquid ring pump manifold according to the first aspect, the liquid ring pump manifold being fluidly connected to the chamber.

DETAILED DESCRIPTION

Figure 1:
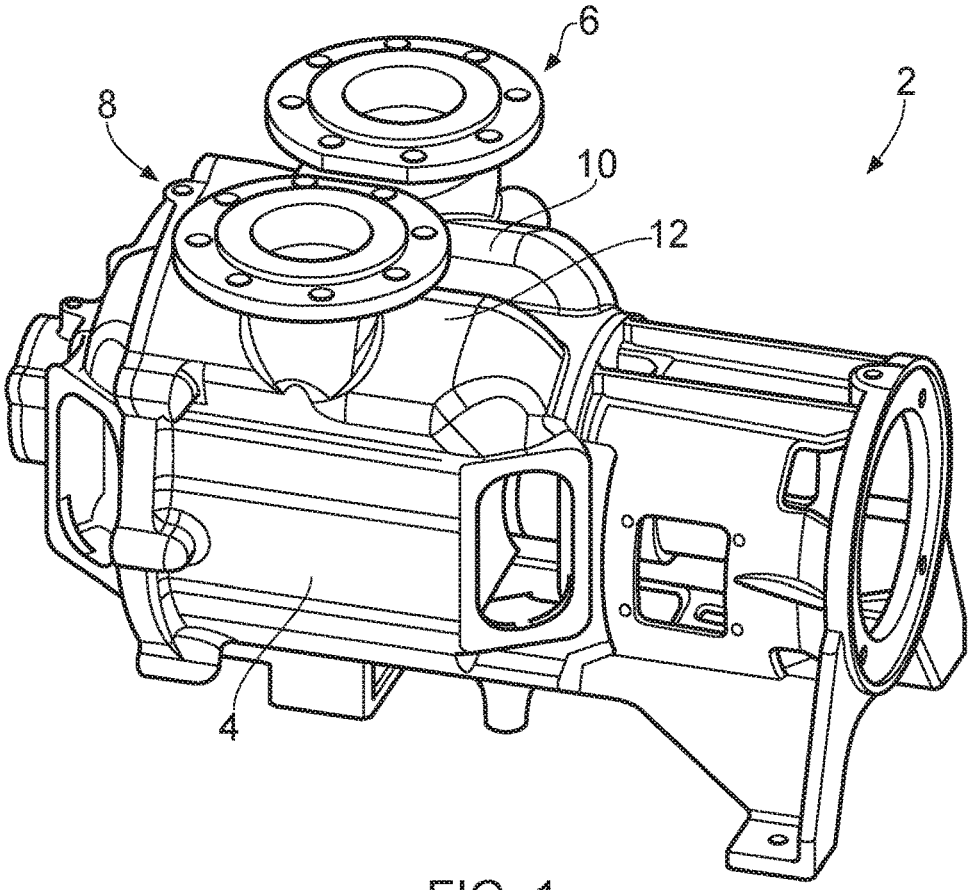
FIG. 1 is a schematic illustration (not to scale) showing a perspective view of a single-stage liquid ring pump.

FIG. 1 is a schematic illustration (not to scale) showing a perspective view of a liquid ring pump 2 in which an embodiment of a liquid ring pump manifold is implemented.

In this embodiment, the liquid ring pump 2 is a single-stage liquid ring pump. The liquid ring pump 2 comprises a housing 4, an inlet 6, and an outlet 8.

The inlet 6 is configured to receive gas from a gas source (not shown) outside of the liquid ring pump 2. The inlet 6 comprises an inlet manifold 10 which will be described below in more detail later with reference to FIGS. 3 to 11.

The outlet 8 is configured to discharge gas from inside the liquid ring pump 2 out of the liquid ring pump 2. The outlet 8 comprises an outlet manifold 12.

Figure 2:
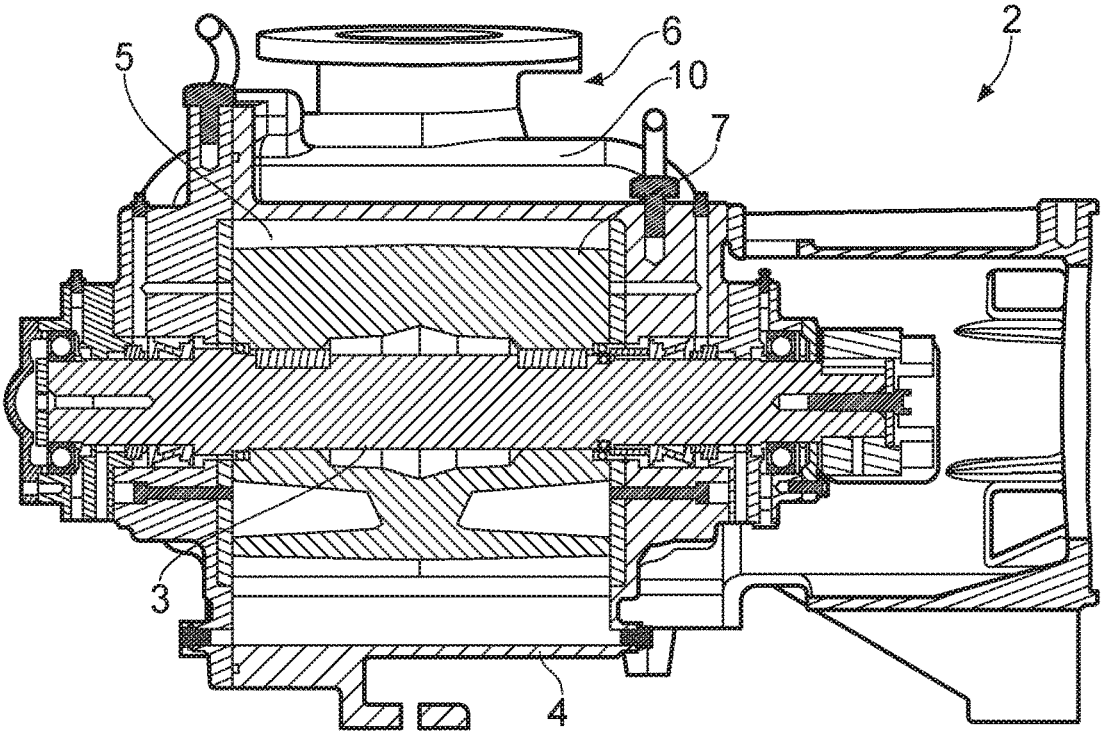
FIG. 2 is a schematic illustration (not to scale) showing a cross-sectional view of the single-stage liquid ring pump.

FIG. 2 is a schematic illustration (not to scale) showing a cross-sectional view of the liquid ring pump 2.

In this embodiment, the liquid ring pump 2 further comprises a chamber 5 defined by the housing 4, a shaft 3 and an impeller 7. The shaft 3 extends into the chamber 5. The impeller 7 is fixedly mounted to the shaft 3 within the chamber 5. Thus, rotation of the shaft 3 also rotates the impeller 7 within the chamber 5.

In operation, the chamber 5 is partially filled with an operating liquid such as water. Also, a drive system (not shown) coupled to the shaft 3 is operated to rotate the shaft 3 so as to rotate the impeller 7. The rotation of the impeller 7 centrifugally pushes the operating liquid against an inner wall of the chamber 5, thereby causing a liquid ring to be formed against the inner wall of the chamber 5. The liquid ring provides a seal that isolates individual volumes between adjacent vanes of the impeller 7 which are used to move and compress gas in the chamber 5. The mechanism by which liquid ring pumps move and compress gas is well known and will not be described here in detail.

In this embodiment, the inlet 6 and outlet 8 are both fluidly connected to the chamber 5. In operation, gas received by the inlet 6 flows from the inlet 6 into the chamber 5, where it is compressed. This compressed gas then flows from the chamber 5 to the outlet 8, where it is discharged.

Figure 3:
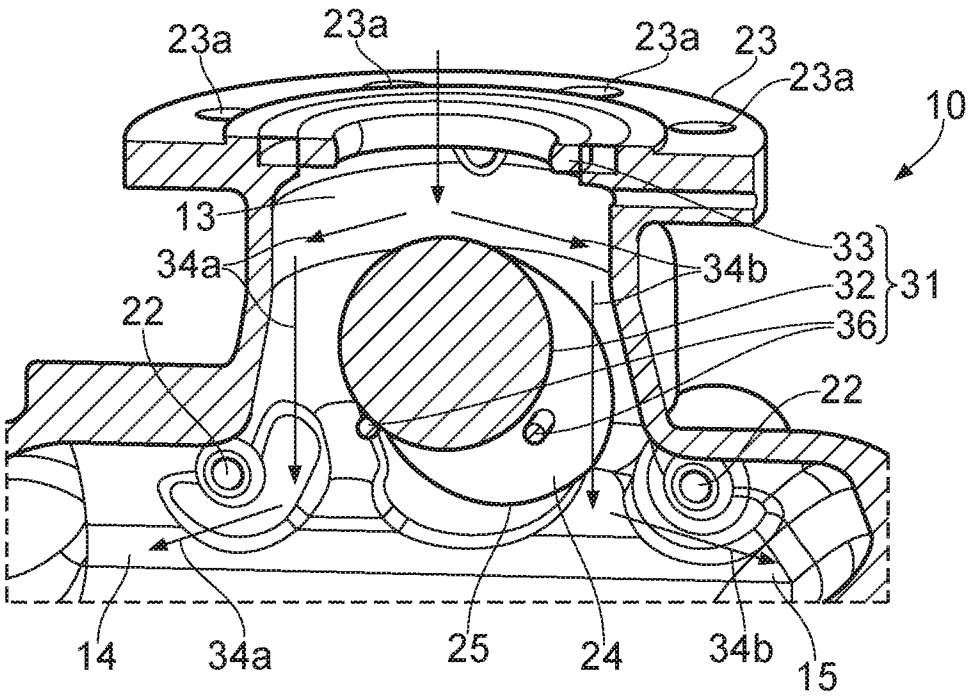
FIG. 3 is a schematic illustration (not to scale) showing a cross-sectional view of an inlet manifold of the single-stage liquid ring pump.

FIG. 3 is a schematic illustration (not to scale) showing a cross-sectional view of an embodiment of the inlet manifold 10 of the liquid ring pump 2. The inlet manifold 10 is configured to split the flow of fluid (i.e. inlet gas) which enters the inlet 6. The inlet manifold 10 comprises a first branch 13 fluidly connected to a second branch 14 and a third branch 15. The first branch 13 splits into the second branch 14 and the third branch 15. More specifically, in this embodiment, the first branch 13 bifurcates into the second branch 14 and the third branch 15.

In operation, gas flowing into the inlet manifold 10 is first received into the first branch 13. Then, part of the received gas in the first branch 13 flows from the first branch 13 into the second branch 14 via a first flow path 34*a*. The rest of the received gas in the first branch 13 flows from the first branch 13 into the third branch 15 via a second flow path 34*b*. In other words, the gas received by the first branch 13 of the inlet manifold 10 is split (e.g. substantially equally split) between flowing into either the second branch 14 or the third branch 15. Following this, the gas in the second branch 14 flows from the second branch 14, out of the inlet manifold 10, and into the chamber 5 of the liquid ring pump 2. Similarly, the gas in the third branch 15 flows from the third branch 15, out of the inlet manifold 10, and into the chamber 5 of the liquid ring pump 2. In this way, gas received by the inlet manifold 10 is able to flow from the inlet manifold 10 to the chamber 5 of the liquid ring pump 2 via two different routes (e.g. in parallel). By providing two different routes to the chamber 5, the volumes between adjacent impeller vanes in the chamber 5 tend to be more efficiently filled with gas from the inlet 6 during operation of the liquid ring pump 2 (compared to using only a single route). In this embodiment, the inlet 6 further comprises a coupling flange 23 for coupling the inlet 6 to piping (not shown) which is external to the liquid ring pump 2. In this embodiment, the coupling flange 23 is an annular disc surrounding an opening of the inlet manifold 10. The coupling flange 23 comprises a plurality of coupling holes 23*a* which can be used to attach the coupling flange 23 to external piping. The external piping may, for example, be suction line piping which is used to fluidly connect the inlet 6 to a gas source (e.g. premises at which a vacuum or low-pressure environment is to be formed), thereby to allow the liquid ring pump 2 to draw or pump gas from the gas source.

In this embodiment, the inlet manifold 10 comprises a non-return valve 31, two spray nozzles 22, an access port 25, and a removable cover 24.

Non-return valves (also known as one-way valves or check valves) are valves which permit fluid flow in one direction, and which prevent or oppose fluid flow in the opposite direction to the direction in which fluid flow is permitted. In this embodiment, the non-return valve 31 of the inlet manifold 10 is disposed in the first branch 13 of the inlet manifold 10, and comprises an annular flange 33 defining a substantially circular opening, a ball 32, and a holder 36.

In this embodiment, the annular flange 33 is disposed on an inner side of a wall of the inlet manifold 10, and positioned at a distal end of the first branch 13. In this embodiment, the annular flange 33 is concentric with the coupling flange 23. The annular flange 33 comprises a chamfered rim circumscribing the opening. In this embodiment, the annular flange 33 is integrally formed with the wall of the inlet manifold 10.

In this embodiment, the ball 32 is a substantially spherical object which is disposed within the first branch 13 of the inlet manifold 10. The ball 32 is movable between a first position (also referred to herein as an open position of the non-return valve 31) in which it is not blocking the opening, and a second position in which it is blocking the opening (also referred to herein as a closed position of the non-return valve 31). Thus, in the first position the ball 32 is configured to permit fluid flow through the opening, and in the second position the ball 32 is configured to prevent or oppose fluid flow through the opening. In other words, the ball 32 is able to act as a plug for the opening.

The holder 36 is configured to hold the ball 32 when the ball 32 is in the first position. In this embodiment, the holder 36 is attached to the removable cover 24. In this embodiment, the holder 36 comprises two protrusions (e.g. rods) 39. The protrusions are attached to and extend from the surface of the removable cover 24 that defines a part of the inner surface of the inlet manifold 10 when the removable cover 24 is fixed to the inlet manifold 10 such that it covers the access port 25. In this embodiment, the two protrusions are attached to the removable cover 24 and extend from the removable cover 24 into the interior (i.e. a flow channel) of the inlet manifold 10.

The access port 25 is an opening in the wall of the inlet manifold 10 through which the interior (i.e. the flow channel) of the inlet manifold 10 can be accessed from outside of the inlet manifold 10. In this embodiment, the access port 25 is located in the wall of the first branch 13 of the inlet manifold 10. The removable cover 24 is a plate which is removably attached to the wall of the inlet manifold 10 so as to cover and seal the access port 25. The removable cover 24 can be removed to expose the access port 25, thereby allowing access to the interior of the inlet manifold 10. This allows a user to perform maintenance (e.g. inspection, cleaning, replacement and/or repair operations) on the interior of the inlet manifold 10. After maintenance services have been performed, the removable cover 24 can then be re-attached to cover and seal the access port 25 once again. When the removable cover 24 is attached so as to cover the access port 25 (as shown in FIG. 3), fluid inside the inlet manifold 10 cannot escape the inlet manifold 10 via the access port 25. In other words, the removable cover 24 is attachable to the wall of the inlet manifold 10 to seal the access port 25 in a fluid-tight manner.

The presence of the removable cover 24 and access port 25 means that the interior of the inlet manifold 10 and the non-return valve 31 can be easily accessed for maintenance (e.g. inspection, cleaning, repair, and/or replacement). This advantageously tends to facilitate maintenance of the interior of the inlet manifold 10 and the non-return valve 31. Furthermore, the interior of the inlet manifold 10 and the non-return valve 31 can be accessed for maintenance without detaching the inlet manifold 10 from any pipework (e.g. a suction line pipe) to which it is connected. Also, since the holder 36 is attached to the removable cover 24, the holder 36 can be removed along with the removable cover 24 in order to allow the holder 36 to be maintained. By removing the holder 36 along with the removable cover 24, more working space tends to be created within the interior of the inlet manifold 10 for maintenance work.

In some embodiments, the access port 25 is larger than the ball 32. Removing the removable cover 24 from the inlet manifold 10 may also remove the holder 36 (which is attached to the inner surface of the removable cover 24) and the ball 32 that is held by the holder 36. This advantageously tends to facilitate maintenance of the ball 32, and also of the interior of the inlet manifold 10.

The spray nozzles 22 are components which are configured to spray operating liquid (such as water) into the flow channel of the inlet manifold 10 from an operating liquid source (not shown). The spray nozzles 22 will be described in more detail below with reference to FIGS. 9 to 11.

The operation of the non-return valve 31 will now be described in more detail with reference to FIGS. 4 to 7.

Figure 4:
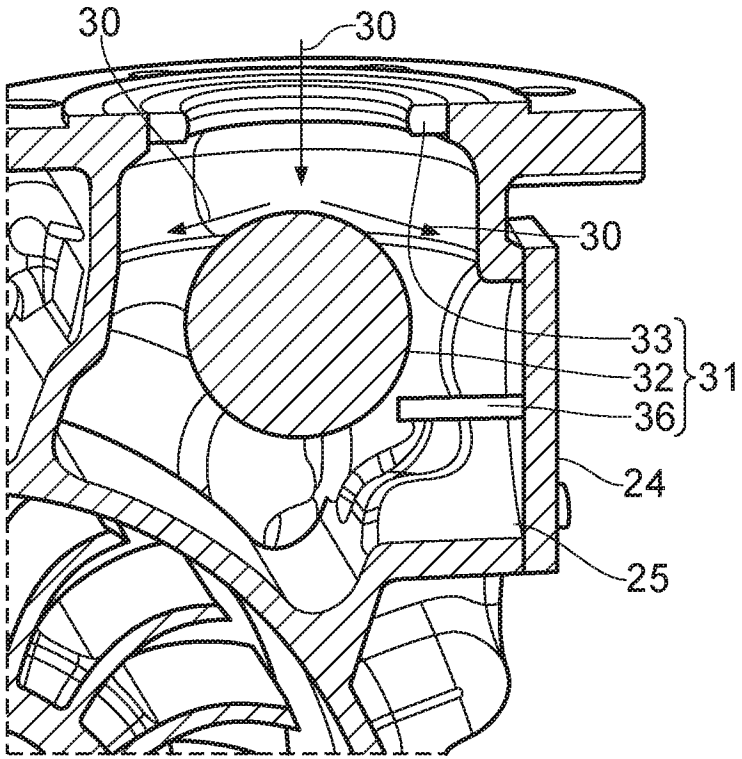
FIG. 4 is a schematic illustration (not to scale) showing a cross-sectional view of the inlet manifold with a non-return valve in an open position.

FIG. 4 is a schematic illustration (not to scale) showing a cross-sectional view of the non-return valve 31 in its open position. During operation of the liquid ring pump 2, rotation of the impeller 7 inside the chamber 5 draws gas into the inlet manifold 10 from a gas source through the opening defined by the annular flange 33 as indicated by arrows 30. The gas flowing into the inlet manifold 10 pushes against the ball 32, which urges the ball 32 in a direction away from the opening and towards the holder 36. Thus, the ball 32 is moved into abutment with the holder 36, which holds the ball 32 in place as the gas flowing into the inlet manifold 10 continues to push against the ball 32. In this way, the non-return valve is maintained in its open position during operation of the liquid ring pump 2.

Figure 5:
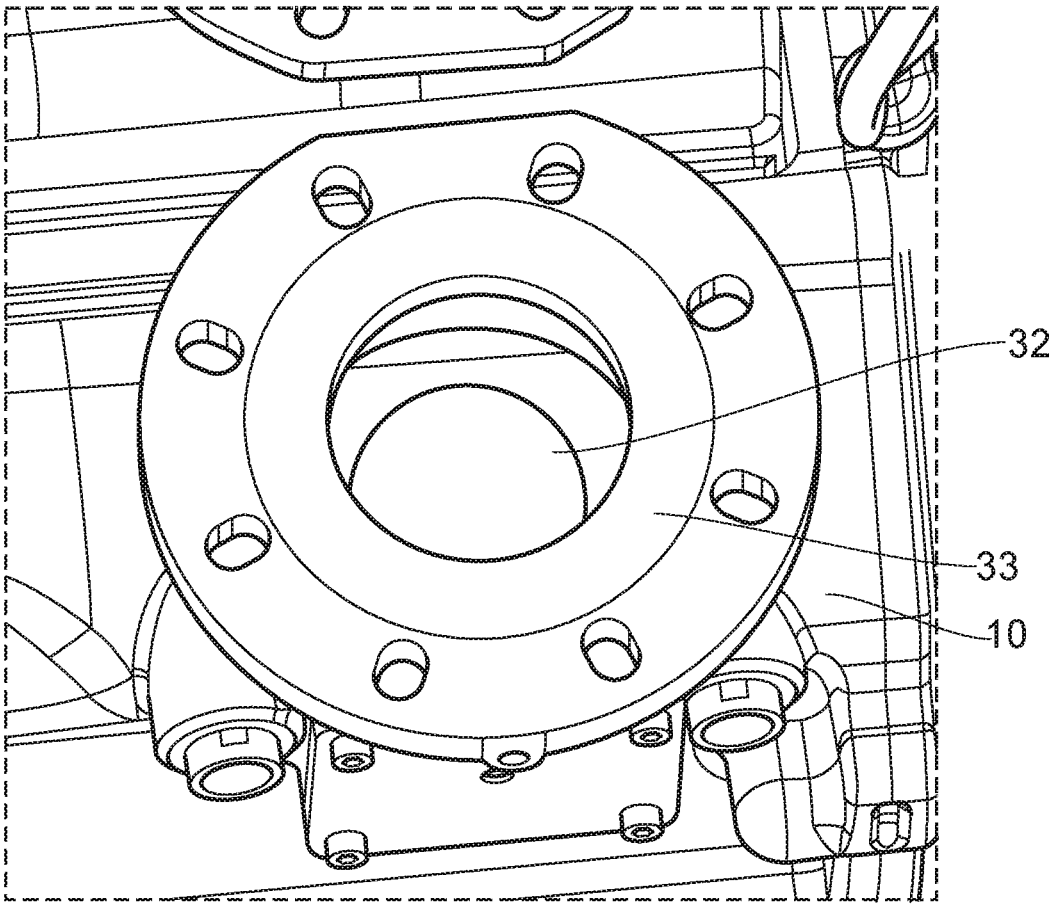
FIG. 5 is a schematic illustration (not to scale) showing a perspective view of the inlet manifold with the non-return valve in an open position.

FIG. 5 is a schematic illustration (not to scale) showing a perspective view of the inlet manifold 10 with the non-return valve in its open position. In the open position, the ball 32 is located away from the annular flange 33 so that it is not in abutment with the annular flange 33.

Figure 7:
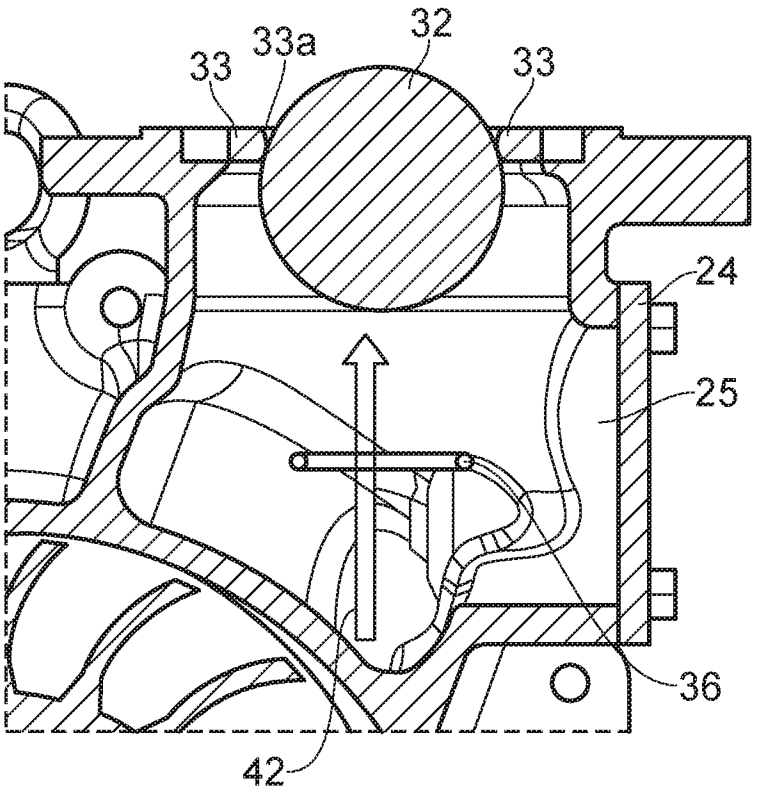
FIGS. 6 and 7 are schematic illustrations (not to scale) showing cross-sectional views of the inlet manifold with the non-return valve in a closed position.
Figure 6:
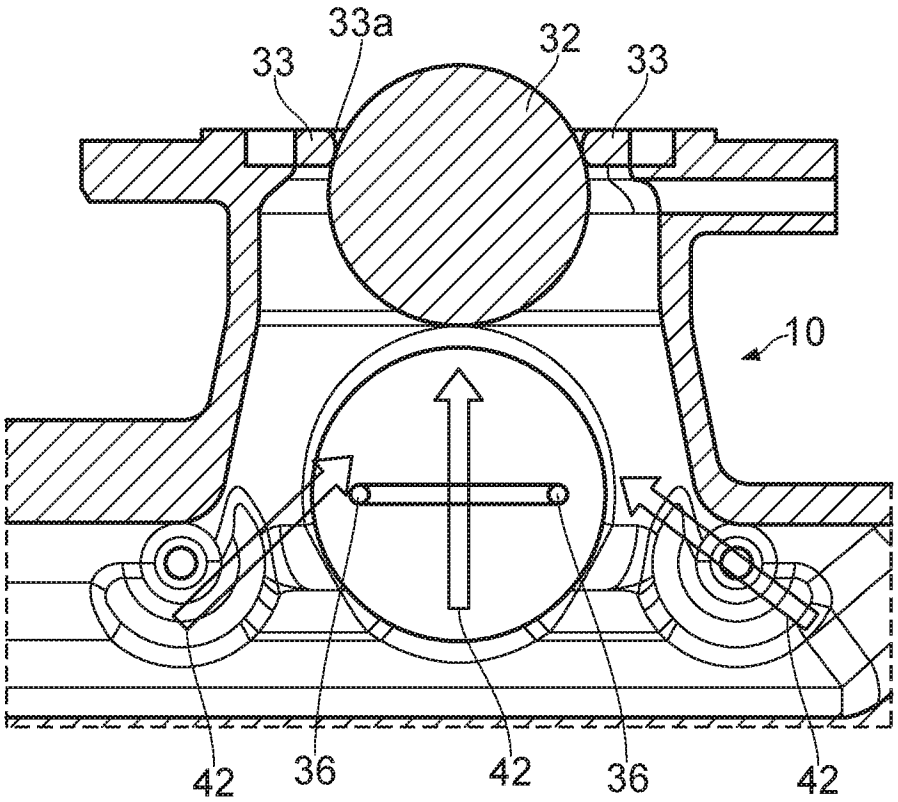

FIGS. 6 and 7 are schematic illustrations (not to scale) showing cross-sectional views of the non-return valve 31 in its closed position. When the pressure inside the chamber 5 of the liquid ring pump 2 is higher than the pressure of the gas source (e.g. when the liquid ring pump 2 is shutdown/not in operation), gas (and potentially operating liquid) from inside the chamber 5 of the liquid ring pump 2 tends to flow back into the inlet manifold 10 as a result of the pressure difference (as indicated by arrows 42). In this case, the gas from the chamber 5 flows into the first branch 13 of the inlet manifold 10 via the second and third branches 14, 15 of the inlet manifold 10. In a similar manner to that described above, this gas pushes against the ball 32, which urges the ball 32 in a direction away from the holder 36 and towards the opening defined by the annular flange 33. Since the ball 32 matches the shape of the opening and is larger in diameter than the opening, it cannot fit through the opening. Thus, the ball 32 is moved into abutment with the annular flange 33 and blocks the opening. More specifically, the ball 32 is moved into abutment with the chamfered rim 33*a* of the annular flange 33. The chamfering advantageously tends to improve contact between the rim and the ball 32, thus providing an improved seal between the ball 32 and the annular flange 33. Following this, the ball 32 is held in place against the annular flange 33 as the gas from the chamber 5 continues to push the ball 32 against the annular flange 33 (due to the pressure difference between the pressure inside the chamber 5 and the pressure of the gas source). In this way, the non-return valve 31 is maintained in its closed position.

Thus, in its closed position, the non-return valve 31 prevents gas which is inside the chamber 5 and/or inlet manifold 10 from flowing from the chamber 5 and/or inlet manifold 10 to the gas source through the opening. The non-return valve 31 in its closed position also prevents operating liquid which is inside the chamber 5 and/or inlet manifold 10 from flowing from the chamber 5 and/or inlet manifold 10 to the gas source through the opening.

Thus, the non-return valve 31 permits flow of fluid in one direction through the inlet manifold 10, and prevents or opposes flow of fluid in the opposite direction through the inlet manifold 10.

A further function of the non-return valve 31 is that when more than one liquid ring pump 2 is used to pump gas from a gas source at the same time (e.g. by connecting the multiple liquid ring pumps 2 to the gas source using common pipework), the non-return valve 31 of each liquid ring pump 2 acts to automatically isolate that liquid ring pump 2 from the gas source in the event that that liquid ring pump 2 shuts down.

Figure 8:
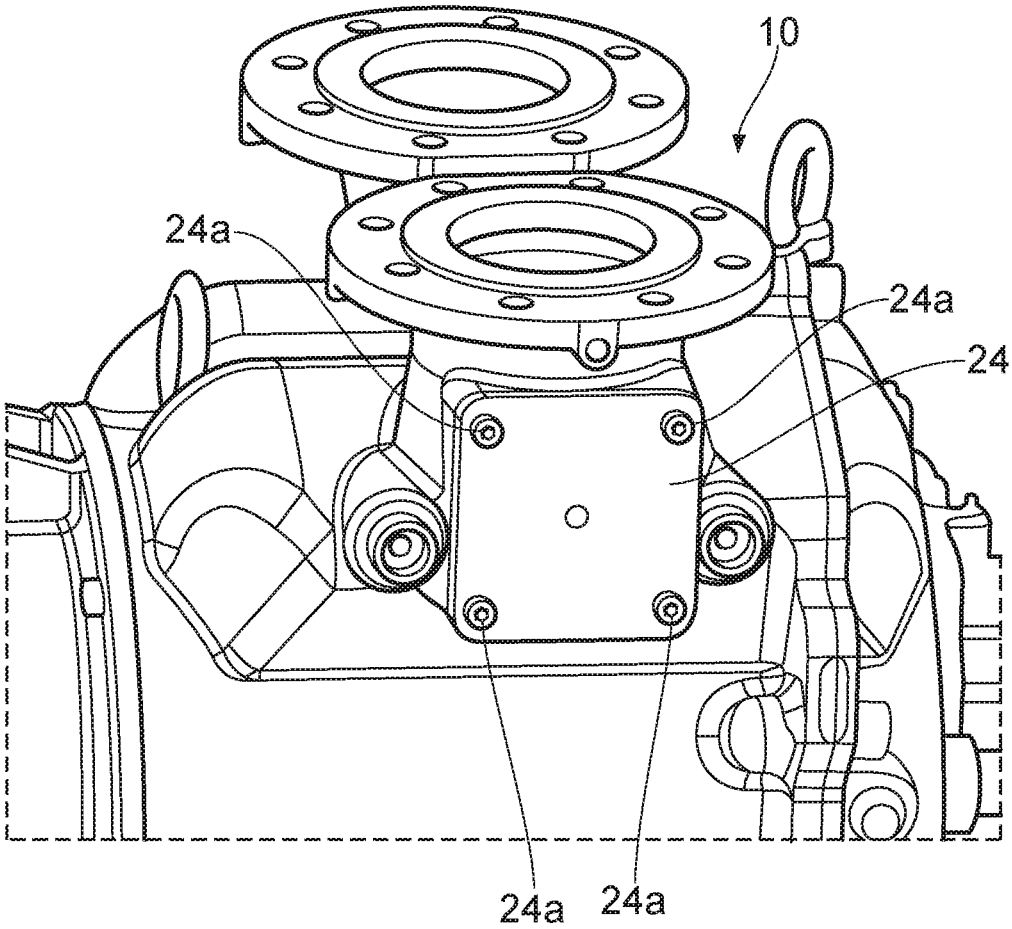
FIG. 8 is a schematic illustration (not to scale) showing a perspective view of a removable cover of the inlet manifold.

FIG. 8 is a schematic illustration (not to scale) showing a perspective view of the removable cover 24 of the inlet manifold 10. In this embodiment, the removable cover 24 is attached to the wall of the inlet manifold 10 by a plurality of bolts 24*a*. More specifically, the removable cover 24 comprises a plurality of holes through which the plurality of bolts 24*a* are passed in order to attach the removable cover 24 to the wall of the inlet manifold 10. The wall of the inlet manifold 10 has corresponding holes for receiving the bolts 24*a*.

To remove the removable cover 24 from the inlet manifold 10, the bolts 24*a* are first removed using an appropriate tool by a user. Then, the user detaches the removable cover 24 from the wall of the inlet manifold 10 and removes the removable cover 24 from the wall of the inlet manifold 10. This also removes the holder 36 and the ball 32 held by the holder 36 from the interior of the inlet manifold 10, since the holder 36 is attached to the removable cover 24. In this way, the access port 25 is exposed, which allows the user to access the interior of the inlet manifold 10. Maintenance (e.g. inspection, cleaning, repair, replacement) of the holder 36, the ball 32, and/or the interior of the inlet manifold 10 may then be performed. To reinstall the non-return valve 31 and the cover 24 in the inlet manifold 10, the above described removal process is reversed.

The spray nozzles 22 of the inlet manifold 10 will now be described in more detail with reference to FIGS. 9 to 11.

As mentioned above, the spray nozzles 22 are components of the inlet manifold 10 which are configured to spray operating liquid into the inlet manifold 10 from an operating liquid source (not shown). The sprayed liquid is the same liquid as the liquid used to form the liquid ring of the liquid ring pump 2.

In this embodiment, the operating liquid sprayed by the spray nozzles 22 has a lower temperature than that of the interior of the inlet manifold 10 and that of the chamber 5. Thus, the sprayed operating liquid tends to cause condensation of evaporated vapour in the gas in the inlet manifold 10 and the chamber 5. This tends to increase the volume of operating liquid present in the chamber 5 of the liquid ring pump 2, since the condensed vapour tends to mix with the liquid ring in the chamber 5. This in turn tends to advantageously reduce the amount of operating liquid that is supplied to the chamber 5 by other means. Furthermore, the condensation of evaporated vapour in the chamber 5 tends to reduce the volume of evaporated vapour (i.e. the partial pressure of the vapour tends to be reduced) being pumped by the liquid ring pump 2. This means that more gas from the gas source tends to be pumped, which increases the efficiency of the liquid ring pump 2.

Figure 9:
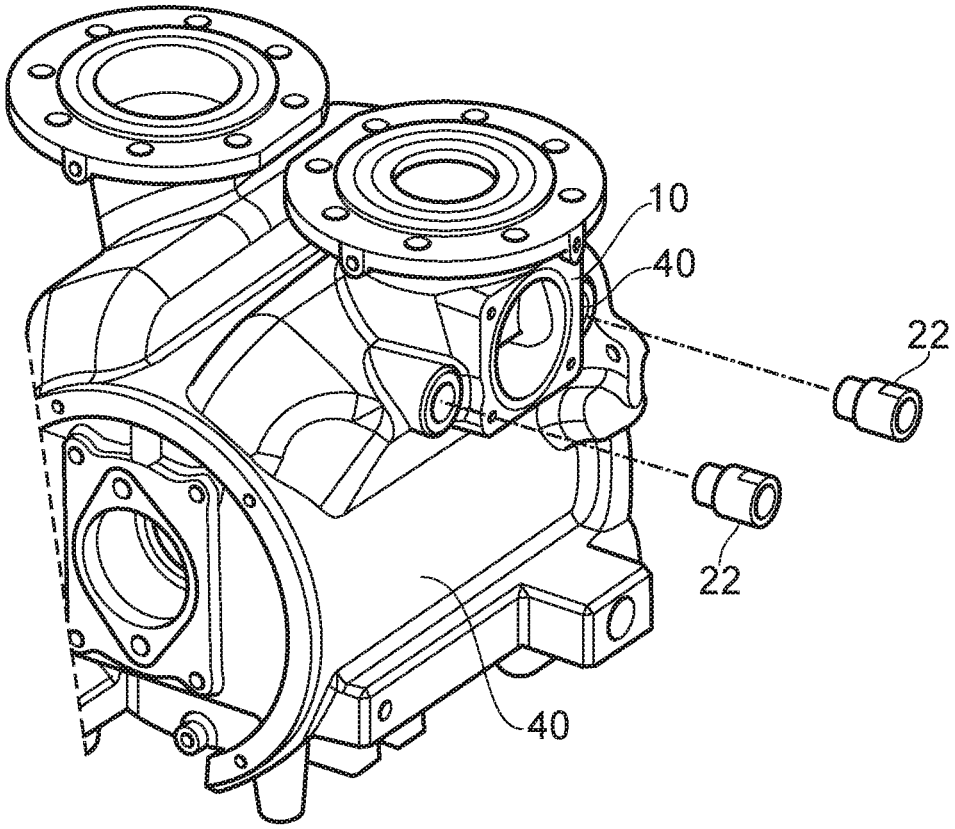
FIG. 9 is a schematic illustration (not to scale) showing a perspective view of the inlet manifold and its spray nozzles.

FIG. 9 is a schematic illustration (not to scale) showing an exploded perspective view of the liquid ring pump 2, with the spray nozzles 22 spaced apart from the inlet manifold 10.

In this embodiment, the inlet manifold 10 of the liquid ring pump 2 comprises two sockets 40 in the wall of the inlet manifold 10 (e.g. integrally formed with the inlet manifold 10). Each spray nozzle 22 is received by a respective socket 40 so that each spray nozzle 22 is accommodated in a respective socket 40. The sockets 40 are fluidly connected to the interior (i.e. flow channel) of the inlet manifold 10 so that the spray nozzles 22 accommodated in the sockets 40 are also fluidly connected to the interior of the inlet manifold 10. Thus, the spray nozzles 22 are arranged to spray liquid into the inlet manifold 10.

In this embodiment, the spray nozzles 22 are substantially identical to each other.

Figure 10:
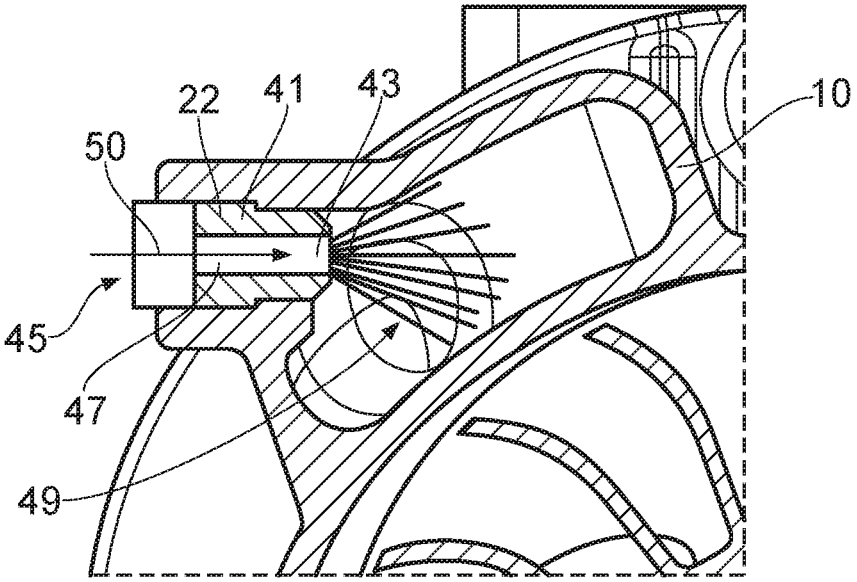
FIG. 10 is a schematic illustration (not to scale) showing a cross-sectional view of one the spray nozzles.

FIG. 10 is a schematic illustration (not to scale) showing a cross-sectional view of the inlet manifold 10 through one of the sockets 40. A spray nozzle 22 is located in the socket 40. In this embodiment, the spray nozzle 22 is configured to spray operating liquid into the inlet manifold 10, as indicated in FIG. 10 by an arrow and the reference numeral 50, and by lines extending from the spray nozzle 22 into the interior of the inlet manifold 10.

In this embodiment, the spray nozzle 22 has a tubular body 41 defining a channel 47 therein. The tubular body 41 comprises a first end 43 and a second end 45. The channel 47 is disposed between the first and second ends 43, 45 such that operating liquid can flow between the first and second ends 43, 45 through the channel 47. In operation, operating liquid is received into the spray nozzle 22 from a source of the operating liquid at the second end 45, flows from the second end 45 to the first end 43 through the channel 47, and is sprayed out of the spray nozzle 22 from the first end 43 into the inlet manifold 10. In order to spray the operating liquid out of the spray nozzle 22, the spray nozzle 22 is fluidly connected to the source of the operating liquid and the operating liquid is forced out of the first end 43 of the spray nozzle 22. More specifically, the operating liquid is forced through the spray nozzle 22 by a pressure differential across the spray nozzle 22. For example, the operating liquid pressure at the second end 45 of the spray nozzle 22 may be ≥1 bar and the operating liquid pressure at the first end 43 of the spray nozzle 22 may be substantially zero (i.e. vacuum pressure). As indicated by the lines 49 extending from the spray nozzle 22, the operating liquid exits the spray nozzle 22 in multiple different directions. More specifically, the spray nozzle 22 sprays out a cone shaped pattern of droplets. This tends to provide a wide area of coverage for the spray. FIG. 11 is a schematic illustration (not to scale) showing a cross-sectional view of the inlet manifold 10 which illustrates the flow of the operating liquid sprayed into the inlet manifold 10 by the spray nozzles 22.

Figure 11:
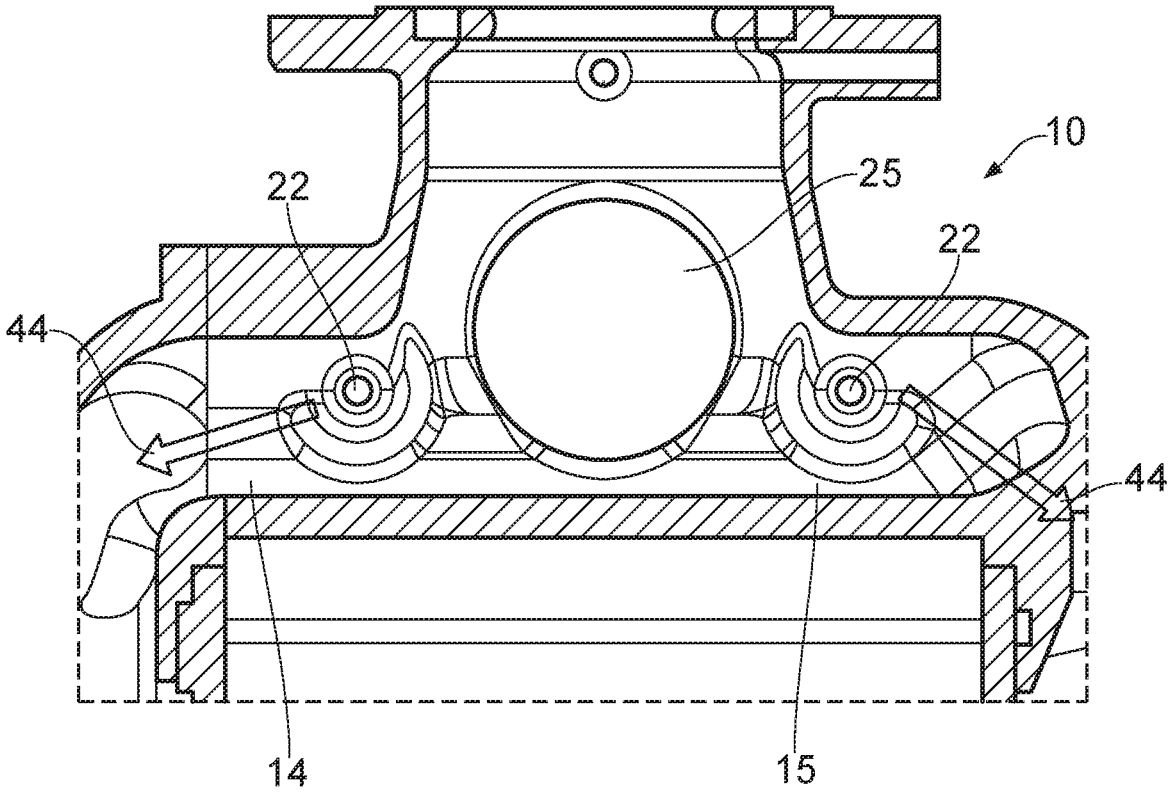
FIG. 11 is a schematic illustration (not to scale) showing a cross-sectional view of the inlet manifold and the operation of the spray nozzles.

In this embodiment, the operating liquid sprayed into the inlet manifold 10 from the spray nozzles 22 flows into the second and third branches 14, 15 of the inlet manifold 10, as indicated in FIG. 11 by arrows 44. More specifically, one of the spray nozzles 22 is positioned so as to spray the operating liquid into the second branch 14. The other one of the two spray nozzles 22 is positioned so as to spray the operating liquid into the third branch 15. In this embodiment, the spray nozzles 22 are positioned so as to be located after the split in the first branch 13 (by being positioned in the second and third branches 14, 15, respectively).

In this embodiment, the spray nozzles 22 point away from the access port 25. Thus, the spray nozzles 22 spray operating liquid in a direction away from the access port 25.

Each spray nozzle 22 is configured to spray the operating liquid into a respective one of the second and third branches 14, 15. In this way, each of the second and third branches 14, 15 is provided with its own dedicated supply of operating liquid from a respective one of the spray nozzles 22.

After being sprayed into the second and third branches 14, 15, the operating liquid flows out of the second and third branches 14, 15 into the chamber 5 of the liquid ring pump 2. More specifically, the operating liquid is carried out of the second and third branches 14, 15 by the flow of the gas in the second and third branches 14, 15 during operation of the liquid ring pump 2. Thus, the operating liquid sprayed by the spray nozzles 22 flows via the inlet manifold 10 into the chamber 5 of the liquid ring pump 2 via two different routes (e.g. in parallel).

After entering the chamber 5, the operating liquid sprayed by the spray nozzles 22 merges with the operating liquid in the liquid ring in the chamber 5. Thus, the sprayed operating liquid becomes part of the liquid ring of liquid ring pump 2.

During operation of the liquid ring pump 2, the operating liquid in the liquid ring of the liquid ring pump 2 is continuously being pushed out of the chamber 5 by the rotation of the impeller 7 (i.e. from the chamber 5 to the outlet 8 of the liquid ring pump 2). This tends to reduce the volume of the liquid ring, which in turn tends to cause the liquid ring pump 2 to operate less efficiently and/or malfunction. As such, it is desirable to replenish the liquid ring in order to maintain the volume of the liquid ring. As described above, the operating liquid sprayed into the inlet manifold 10 by the spray nozzles 22 becomes part of the liquid ring after flowing into the chamber 5 from the inlet manifold 10. In this way, the liquid sprayed by the spray nozzles 22 replenishes the liquid ring of the liquid ring pump 2, at least to some extent.

FIG. 11 also shows the access port 25 of the inlet manifold 10. Similar to the non-return valve described above, the spray nozzles 22 can also be accessed through the access port 25 for maintenance. More specifically, the first ends 43 of the spray nozzles 22 can be accessed through the access port 25 without removal of the spray nozzles 22 from the sockets 40. This allows maintenance of the spray nozzles 22 without removal of the spray nozzles from the sockets 40.

The above-described inlet manifold comprises an integral or integrated non-return valve. Also, the above-described inlet manifold comprises integral or integrated spray nozzles. In other words, the non-return valve and spray nozzles are integrated in the inlet manifold as part of the inlet manifold. Advantages of such integration will now be described.

Conventionally, the inlet manifolds of liquid ring pumps do not have an integral or integrated non-return valve. The inlet manifold of the liquid ring pump having an integral or integrated non-return valve advantageously tends to reduce or eliminate use of a separate section of pipe that contains a non-return valve. This avoidance of a separate non-return valve pipe section tends to mean that fewer connections (e.g. joints) are formed between the liquid ring pump and the source of the gas being pumped by the liquid ring pump. In liquid ring pumps which use vertical entry of gas (such as the one shown in FIG. 1), this in turn tends to reduce the overall installation height. Also, the risk of leakage tends to be reduced due to the above-mentioned lower number of connections. Thus, efficiency of the liquid ring pump tends to be improved. Also, the material cost associated with the liquid ring pump tends to be reduced, for example because the use of a separate section of pipe containing a non-return valve is reduced or eliminated. Furthermore, the integration of the non-return valve also tends to safeguard against human error during installation of the liquid ring pump at a location.

Furthermore, a non-return valve integrated in an inlet manifold with the above described access port and removable cover tends to be easier to maintain compared to a non-return valve contained in a separate section of pipe, since the access port tends to allow easy access to the non-return valve.

In addition, a non-return valve integrated in the inlet manifold advantageously tends to restrict flow of gas to a lesser extent than a non-return valve contained in a separate section of pipe.

The integrated non-return valve of the above embodiments tends to be particularly useful in liquid ring pumps which are operated with variable speed drive (VSD). VSD is a way of operating liquid ring pumps in which a controller controls the liquid ring pump to vary the speed at which the liquid ring pump pumps gas. When VSD is used, the liquid ring pump tends to be shut down if it is run at too low a speed for too long a time (for example, in order to save energy). As described above, when the liquid ring pump shuts down, gas from the chamber of the liquid ring pump attempts to flow back from the chamber and out of the liquid ring pump via the inlet manifold. Thus, the presence of a non-return valve tends to be of particular importance for liquid ring pumps which are operated using VSD, since liquid ring pumps operated using VSD tend to be shut down more often (for example, in order to save energy as mentioned above) than liquid ring pumps operated at a fixed speed.

Conventionally, inlet manifolds of liquid ring pumps do not have integral or integrated spray nozzles. The inlet manifold of the liquid ring pump having integral or integrated spray nozzles advantageously tends to reduce or eliminate use of a separate section of pipe that contains a spray nozzle. This avoidance of a separate spray nozzle pipe section tends to mean that fewer connections (e.g. joints) are formed between the liquid ring pump and the source of the gas being pumped by the liquid ring pump. In liquid ring pumps which use vertical entry of gas (such as the one shown in FIG. 1), this in turn tends to reduce the overall installation height. Also, the risk of leakage tends to be reduced due to the above-mentioned lower number of connections. Thus, efficiency of the liquid ring pump tends to be improved. Also, the material cost associated with the liquid ring pump tends to be reduced, for example because the use of a separate section of pipe containing a spray nozzle is reduced or eliminated. Furthermore, the integration of the spray nozzles also tends to safeguard against human error during installation of the liquid ring pump at a location.

Furthermore, by using multiple spray nozzles to spray operating liquid into the second and third branches of the inlet manifold, the use of smaller spray nozzles tends to be enabled (compared to using a single larger spray nozzle for example). This is because the sprayed operating liquid is split between the multiple spray nozzles, and so each spray nozzle may spray a relatively smaller amount of operating liquid.

Also, the velocity of the gas being pumped through the inlet manifold tends to decrease after the gas flow splits between the second and third branches. By using multiple spray nozzles to spray operating liquid into the second and third branches, the sprayed operating liquid contacts the gas after the split. Thus, due to the above-mentioned decreased velocity of the gas, contact time between the sprayed operating liquid and the gas tends to be increased. This tends to allow for more heat transfer from the gas to the sprayed operating liquid, which in turn tends to cause more condensation of vapour in the gas. Furthermore, by positioning the spray nozzles in the second and third branches, the spray nozzles do not tend to spray operating liquid into the first branch. This advantageously tends to reduce the risk of dirt and/or deposits forming on the components of the non-return valve (e.g. the ball).

Thus, a liquid ring pump manifold with an integrated non-return valve and integrated spray nozzles is provided.

In the above embodiments, the liquid ring pump is single-stage liquid ring pump. However, in other embodiments, the liquid ring pump is a different type of liquid ring pump, for example a multi-stage liquid ring pump.

In the above embodiments, the non-return valve is integrated in the inlet manifold of the liquid ring pump. However, in other embodiments, a non-return valve is integrated in the outlet manifold of the liquid ring pump. In some embodiments, each of the inlet and outlet manifolds have respective integrated non-return valves. A non-return valve integrated in the outlet manifold may prevent gas from returning back into the chamber of liquid ring pump from outside the liquid ring pump via the outlet manifold. This tends to be particularly useful if the liquid ring pump is used as a gas compressor.

In the above embodiments, the object used to block the opening defined by the annular flange is a substantially spherical ball. However, in other embodiments, a different type of object is used to block the opening defined by the annular flange. For example, a hinged flap or non-spherical object may be used.

In the above embodiments, the opening defined by the annular flange is substantially circular. This matches the cross-sectional shape of the substantially spherical ball. However, in other embodiments, the opening is a different shape. It will be appreciated that, in general, the object and opening can be any suitable shape.

In the above embodiments, the annular flange is positioned at a distal end of the first branch. However, in other embodiments, the annular flange may be located at a different position in the inlet manifold.

In the above embodiments, the annular flange comprises a chamfered rim. However, in other embodiments, the rim is not chamfered.

In the above embodiments, the holder comprises two protrusions. However, in other embodiments, the holder comprises other structures which are suitable for holding the object instead of or in addition to the two protrusions. Furthermore, in some embodiments, the holder comprises a different number of protrusions, e.g. more than two protrusions or a single protrusion.

In the above embodiments, the two protrusions are attached to the removable cover and extend from the removable cover. However, in other embodiments, one or both of the protrusions are attached to a different part of the inlet manifold and extend from that part. For example, the protrusions may be attached to and extend from a part of the inner surface of the inlet manifold which is not defined by the removable cover.

In the above embodiments, the holder is a separate component to the spray nozzles. However, in other embodiments, the spray nozzles and/or the spray nozzle sockets are used as the holder (at least in part).

In the above embodiments, the sockets are formed in parts of the wall of the inlet manifold which are not defined by the removable cover. However, in other embodiments, the sockets are formed in the removable cover.

In the above embodiments, the inlet manifold has one input branch (i.e. the first branch) and two output branches (i.e. the second and third branches). However, in other embodiments, the inlet manifold has a different number of input branches and/or a different number of output branches. For example, the inlet manifold may comprise a single input branch and more than two output branches, multiple input branches and multiple output branches, multiple input branches and a single output branch, or a single input branch and a single output branch.

In the above embodiments, two spray nozzles are integrated in the inlet manifold. However, in other embodiments, a different number of spray nozzles are integrated in the inlet manifold. For example, only one spray nozzle or more than two spray nozzles may be integrated in the inlet manifold.

In the above embodiments, the two spray nozzles are positioned so as to spray operating liquid into the second and third branches of the inlet manifolds, respectively. However, in other embodiments, one or more spray nozzles are positioned so as to spray operating liquid into different parts of the inlet manifold instead of or in addition to spray nozzles that are positioned so as to spray operating liquid into the second and/or third branches. For example, one or more of the spray nozzles may be positioned so as to spray operating liquid into the first branch.

It will be appreciated that the object used to block the opening can be made of any appropriate material, for example, an elastomeric material such as rubber.

In the above embodiments, the inlet manifold comprises an integrated non-return valve. However, in other embodiments, the integrated non-return valve is omitted.

The invention claimed is:

1. A liquid ring pump manifold comprising:

at least one integrated spray nozzle, the at least one integrated spray nozzle being configured to spray a liquid into the liquid ring pump manifold, and a first branch through which fluid is configured to flow, the first branch splitting into multiple branches through which fluid is configured to flow, wherein the multiple branches include at least a second branch and a third branch, wherein the at least one integrated spray nozzle comprises:

a first integrated spray nozzle positioned so as to spray liquid into the second branch, and a second integrated spray nozzle positioned so as to spray liquid into the third branch.

2. The liquid ring pump manifold of claim 1, further comprising at least one socket in which the at least one integrated spray nozzle is accommodated.

3. The liquid ring pump manifold of claim 2, wherein the at least one socket is integrally formed with the liquid ring pump manifold.

4. The liquid ring pump manifold of claim 1, wherein the first branch bifurcates into the second branch and the third branch.

5. The liquid ring pump manifold of claim 1, further comprising an integrated non-return valve, the integrated non-return valve being configured to permit flow of fluid through the liquid ring pump manifold in a first direction and to prevent or oppose flow of fluid through the liquid ring pump manifold in a second direction, the second direction being opposite to the first direction.

6. The liquid ring pump manifold of claim 5, wherein the integrated non-return valve comprises:

an annular flange defining an opening;

an object movable between a first position and a second position, wherein in the first position the object is located away from the opening so as to not block the opening, and in the second position the object abuts the annular flange so as to block the opening.

7. The liquid ring pump manifold of claim 5, wherein the integrated non-return valve further comprises a holder configured to hold the object when the object is in the first position, wherein the holder comprises at least one protrusion extending from an inner surface of the liquid ring pump manifold.

8. The liquid ring pump manifold of claim 2, wherein the liquid ring pump manifold further comprises:

an access port configured to provide access to an interior of the liquid ring pump manifold from outside of the liquid ring pump manifold; and a removable cover configured to seal the access port so as to prevent fluid flowing from the interior of the liquid ring pump manifold out of liquid ring pump manifold through the access port.

9. The liquid ring pump manifold of claim 8, wherein the at least one socket is formed in the removable cover.

10. The liquid ring pump manifold of claim 7, wherein the at least one integrated spray nozzle forms at least part of the holder.

11. The liquid ring pump manifold of claim 7, further comprising at least one socket in which the at least one integrated spray nozzle is accommodated, wherein the at least one socket forms at least part of the holder.

12. The liquid ring pump manifold of claim 1, wherein the liquid ring pump manifold is selected from the group of manifolds consisting of:

a liquid ring pump inlet manifold; and a liquid ring pump outlet manifold.

13. A liquid ring pump, comprising:

a housing defining a chamber therein;

a shaft extending into the chamber;

an impeller fixedly mounted to the shaft;

a liquid ring pump manifold comprising:

at least one integrated spray nozzle, the at least one integrated spray nozzle being configured to spray a liquid into the liquid ring pump manifold, the liquid ring pump manifold being fluidly connected to the chamber, and a first branch through which fluid is configured to flow, the first branch splitting into multiple branches through which fluid is configured to flow, wherein the multiple branches include at least a second branch and a third branch, wherein the at least one integrated spray nozzle comprises:

a first integrated spray nozzle positioned so as to spray liquid into the second branch, and a second integrated spray nozzle positioned so as to spray liquid into the third branch.

14. The liquid ring pump of claim 13, wherein the liquid ring pump manifold further comprises at least one socket in which the at least one integrated spray nozzle is accommodated.

15. The liquid ring pump of claim 14, wherein the at least one socket is integrally formed with the liquid ring pump manifold.

16. The liquid ring pump of claim 13, wherein the first branch bifurcates into the second branch and the third branch.

* * * * *